US005510001A

United States Patent [19]

Hermans et al.

[11] Patent Number: 5,510,001

[45] Date of Patent: Apr. 23, 1996

[54] METHOD FOR INCREASING THE INTERNAL BULK OF THROUGHDRIED TISSUE

[75] Inventors: Michael A. Hermans, Neenah; Fung-Jou Chen, Appleton; Harry L. Spiegelberg, Appleton; Bernhardt E. Kressner, Appleton; Janice G. Nielsen, Appleton, all of Wis.

[73] Assignee: Kimberly-Clark Corporation, Neenah, Wis.

[21] Appl. No.: 307,988

[22] Filed: Sep. 14, 1994

Related U.S. Application Data

[62] Division of Ser. No. 66,188, May 21, 1993, Pat. No. 5,411, 636.

[51] Int. Cl.[6] ..... D21F 11/00

[52] U.S. Cl. ..... 162/113; 162/109; 162/111; 162/115; 162/207

[58] Field of Search ..... 162/111, 109, 162/112, 113, 115, 117, 207, 359.1, 297

[56] References Cited

U.S. PATENT DOCUMENTS

| | | | |
|---|---|---|---|
| 3,301,746 | 1/1967 | Sanford et al. | 162/113 |
| 3,303,576 | 2/1967 | Sisson | 162/297 |
| 3,905,863 | 9/1975 | Ayers | 162/113 |
| 4,356,059 | 10/1982 | Hostetler | 162/111 |
| 4,637,859 | 1/1987 | Trokhan | 162/113 |
| 4,894,118 | 1/1990 | Edwards et al. | 162/112 |

FOREIGN PATENT DOCUMENTS

| | | | |
|---|---|---|---|
| 0033559 | 8/1981 | European Pat. Off. | D21F 11/00 |
| 0140404 | 5/1985 | European Pat. Off. | D21H 5/02 |
| 0485360 | 5/1992 | European Pat. Off. | D21H 25/00 |
| WO9300475 | 1/1993 | WIPO | D21F 11/00 |

*Primary Examiner*—Peter Chin

[57] ABSTRACT

The internal bulk of a tissue web can be improved during manufacturing of the basesheet by subjecting the tissue web to differential pressure while supported on a coarse fabric at a consistency of about 30 percent or greater. The differential pressure, such as by applying vacuum suction to the underside of the coarse fabric, causes the wet web to deflect into the openings or depressions in the fabric and "pop" back, resulting in a substantial gain in thickness or internal bulk. The method is especially adapted to improve the internal bulk of wet-pressed tissue webs.

5 Claims, 13 Drawing Sheets

METHOD FOR INCREASING THE INTERNAL BULK OF THROUGHDRIED TISSUE

This is a divisional application of application Ser. No. 08/066,188, filed on May 21, 1993, now U.S. Pat. No. 5,411,636.

BACKGROUND OF THE INVENTION

In the manufacture of tissue products, it is generally desireable to provide the final product with as much bulk as possible without compromising other product attributes. However, most tissue machines operating today utilize a process known as "wet-pressing", in which a large amount of water is removed from the newly-formed web by mechanically pressing water out of the web in a pressure nip between a pressure roll and the Yankee dryer surface as the web is transferred from a papermaking felt to the Yankee dryer. This wet-pressing step, while an effective dewatering means, compresses the web and causes a marked reduction in the web thickness and hence bulk.

On the other hand, throughdrying processes have been more recently developed in which web compression is avoided as much as possible in order to preserve and enhance the bulk of the web. These processes provide for supporting the web on a coarse mesh fabric while heated air is passed through the web to remove moisture and dry the web. If a Yankee dryer is used at all in the process, it is for creping the web rather than drying, since the web is already dry when it is transferred to the Yankee surface. Transfer to the Yankee, although requiring compression of the web, does not significantly adversely affect web bulk because the papermaking bonds of the web have already been formed and the web is much more resilient in the dry state.

Although throughdried tissue products exhibit good bulk and softness properties, throughdrying tissue machines are expensive to build and operate. Accordingly there is a need for producing higher quality tissue products by modifying existing, conventional wet-pressing tissue machines.

SUMMARY OF THE INVENTION

It has now been discovered that the bulk of a wet web can be significantly increased with little capital investment by abruptly deflecting the wet web, at relatively high consistency, into the open areas or depressions in the contour of a coarse mesh supporting fabric, preferably by pneumatic means such as one or more pulses of high pressure and/or high vacuum. Such abrupt flexing of the web causes the web to "pop" or expand, thereby increasing the caliper and internal bulk of the wet web while causing partial debonding of the weaker bonds already formed during partial drying or dewatering. This operation is sometimes referred to herein as wet-straining. The web can then be dried to preserve the increased bulk. This discovery is particularly beneficial when applied to wet-pressing processes in which a relatively large number of bonds are formed in the wet state, but it can also be applied to throughdrying processes to further improve the quality of the resulting tissue product.

The effects of wet-straining on the web can be quantified by measuring the "Debonded Void Thickness" (hereinafter described), which is the void area or space not occupied by fibers in a cross-section of the web per unit length. It is a measure of internal web bulk (as distinguished from external bulk created by simply molding the web to the contour of the fabric) and the degree of debonding which occurs within the web when subjected to wet-straining. The "Normalized Debonded Void Thickness" is the Debonded Void Thickness divided by the weight of a circular, four inch diameter sample of the web. The determination of these parameters will be hereinafter described in connection with FIGS. 8–13.

Hence, in one aspect the invention resides in a method for making a tissue product comprising: (a) depositing an aqueous suspension of papermaking fibers onto an endless forming fabric to form a wet web; (b) dewatering or drying the web to a consistency of 30 percent or greater; (c) transferring the web to a coarse mesh fabric; (d) deflecting the web to substantially conform the web to the contour of the coarse fabric; and (e) drying the web.

In another aspect, the invention resides in a method for making a tissue product comprising: (a) depositing an aqueous suspension of papermaking fibers onto an endless forming fabric to form a wet web; (b) transferring the wet web to a papermaking felt; (c) pressing the web to a consistency of about 30 percent or greater; (d) transferring the web to a coarse fabric; (e) deflecting the web to substantially conform the web to the contour of the coarse fabric; (f) throughdrying the web to a consistency of from about 40 to about 90 percent while supported on the coarse fabric; (g) transferring the throughdried web to a Yankee dryer to final dry the web; and (h) creping the web.

In yet another aspect, the invention resides in a method for making a wet-pressed tissue product comprising: (a) depositing an aqueous suspension of papermaking fibers onto an endless forming fabric to form a wet web; (b) transferring the wet web to a papermaking felt; (c) pressing the wet web to a consistency of about 30 percent or greater; (d) transferring the web to a coarse fabric; (e) deflecting the web to substantially conform the web to the contour of the coarse fabric; (f) transferring the web to a transfer fabric; (g) transferring the web to the surface of a Yankee dryer and drying the web to final dryness; and (h) creping the web.

In still another aspect, the invention resides in a method for making a tissue product comprising: (a) depositing an aqueous suspension of papermaking fibers onto an endless forming fabric to form a wet web; (b) transferring the wet web to a papermaking felt; (c) pressing the web against the surface of a Yankee dryer and transferring the web thereto; (d) partially drying the web to a consistency of from about 40 to about 70 percent; (e) transferring the partially dried web to a coarse fabric; (f) deflecting the web to substantially conform the web to the contour of the coarse fabric; (g) transferring the web to a second Yankee dryer and final drying the web; and (h) creping the web.

In a further aspect, the invention resides in a method for making a throughdried tissue product comprising: (a) depositing an aqueous suspension of papermaking fibers onto an endless forming fabric to form a wet web; (b) transferring the wet web to a throughdryer fabric and partially drying the web in a first throughdryer to a consistency of from about 28 to about 45 percent; (c) sandwiching the partially-dried web between the throughdryer fabric and a coarse fabric; (d) deflecting the web to substantially conform the web to the contour of the coarse fabric; (e) carrying the web on the throughdryer fabric over a second throughdryer to dry the web to a consistency of about 85 percent or greater; (f) transferring the throughdried web to a Yankee dryer; and (g) creping the web.

In yet a further aspect, the invention resides in a method for making a throughdried tissue product comprising: (a) depositing an aqueous suspension of papermaking fibers onto an endless forming fabric to form a wet web; (b)

transferring the wet web to a throughdrying fabric; (c) carrying the web over a first throughdryer and partially drying the web to a consistency of from about 28 to about 45 percent; (d) transferring the partially dried web to a second throughdrying fabric; (e) sandwiching the partially dried web between the second throughdrying fabric and a coarse fabric; (f) deflecting the web to substantially conform the web to the contour of the coarse fabric; (g) carrying the web over a second throughdryer to dry the web to a consistency of about 85 percent or greater; (h) transferring the web to a Yankee dryer; and (i) creping the web.

In another aspect the invention resides in a method for making a tissue product comprising: (a) depositing an aqueous suspension of papermaking fibers onto an endless forming fabric to form a wet web; (b) transferring the web to a papermaking felt; (c) compressing the web in a pressure nip to partially dewater the web and transferring the web to a Yankee dryer; (d) partially drying the web on the Yankee dryer to a consistency of from about 40 to about 70 percent; (e) transferring the partially dried web to a coarse mesh fabric; (f) deflecting the web to substantially conform the web to the contour of the coarse fabric; and (g) throughdrying the web.

In all aspects of the invention, the web can be creped, wet or dry, one or more times if desired. Wet creping can be an advantageous means for removing the wet web from the Yankee dryer.

The nature of the coarse fabric is such that the wet web must be supported in some areas and unsupported in others in order to enable the web to flex in response to the differential air pressure or other deflection force applied to the web. Such fabrics suitable for purposes of this invention include, without limitation, those papermaking fabrics which exhibit significant open area or three dimensional surface contour or depressions sufficient to impart substantial z-directional deflection of the web. Such fabrics include single-layer, multi-layer, or composite permeable structures. Preferred fabrics have at least some of the following characteristics: (1) On the side of the molding fabric that is in contact with the wet web (the top side), the number of machine direction (MD) strands per inch (mesh) is from 10 to 200 and the number of cross-machine direction (CD) strands per inch (count) is also from 10 to 200. The strand diameter is typically smaller than 0.050 inch; (2) On the top side, the distance between the highest point of the MD knuckle and the highest point of the CD knuckle is from about 0.001 to about 0.02 or 0.03 inch. In between these two levels, there can be knuckles formed either by MD or CD strands that give the topography a 3-dimensional hill/valley appearance which is imparted to the sheet during the wet molding step; (3) On the top side, the length of the MD knuckles is equal to or longer than the length of the CD knuckles; (4) If the fabric is made in a multi-layer construction, it is preferred that the bottom layer is of a finer mesh than the top layer so as to control the depth of web penetration and to maximize fiber retention; and (5) The fabric may be made to show certain geometric patterns that are pleasing to the eye, which typically repeat between every 2 to 50 warp yarns. Suitable commercially available coarse fabrics include a number of fabrics made by Asten Forming Fabrics, Inc., including without limitation Asten 934, 920, 52B, and Velostar V800.

The consistency of the wet web when the differential pressure is applied must be high enough that the web has some integrity and that a significant number of bonds have been formed within the web, yet not so high as to make the web unresponsive to the differential air pressure. At consistencies approaching complete dryness, for example, it is difficult to draw sufficient vacuum on the web because of its porosity and lack of moisture. Preferably, the consistency of the web will be from about 30 to about 80 percent, more preferably from about 40 to about 70 percent, and still more preferably from about 45 to about 60 percent. A consistency of about 50 percent is most preferred for most furnishes and fabrics.

The means for deflecting the wet web to create the increase in internal bulk can be pneumatic means, such as positive and/or negative air pressure, or mechanical means, such as a male engraved roll having protrusions which match up with the depressions or openings in the coarse fabric. Deflection of the web is preferably achieved by differential air pressure, which can be applied by drawing a vacuum from beneath the supporting coarse fabric to pull the web into the coarse fabric, or by applying positive pressure downwardly onto the web to push the web into the coarse fabric, or by a combination of vacuum and positive pressure. A vacuum suction box is a preferred vacuum source because of its common use in papermaking processes. However, air knives or air presses can also be used to supply positive pressure if vacuum cannot provide enough of a pressure differential to create the desired effect. When using a vacuum suction box, the width of the vacuum slot can be from approximately 1/16" to whatever size is desired, as long as sufficient pump capacity exists to establish sufficient vacuum. In common practice vacuum slot widths from 1/8" to 1/2" are most practical.

The magnitude of the pressure differential and the duration of the exposure of the web to the pressure differential can be optimized depending upon the composition of the furnish, the basis weight of the web, the moisture content of the web, the design of the supporting coarse fabric, and the speed of the machine. Without being held to any theory, it is believed that the sudden deflection of the web, followed by the immediate release of the pressure or vacuum, causes the web to flex down and up and thereby partially debond and hence expand. Suitable vacuum levels can be from about 10 inches of mercury to about 28 inches of mercury, preferably about 15 to about 25 inches of mercury, and most preferably about 20 inches of mercury. Such levels are higher than would ordinarily be used for mere transfer of a web from one fabric to another.

The number of times the wet web can be transferred to a coarse fabric and subjected to a pressure differential can be one, two, three, four or more times. To effect a more uniform bulking of the web, it is preferred that the wet straining vacuum be applied to both sides of the web. This can be conveniently accomplished simply by transferring the web from one fabric to another, in which the web is inherently supported on a different side after each transfer.

The method of this invention can preferably be applied to any tissue web, which includes webs for making facial tissue, bath tissue, paper towels, dinner napkins, and the like. Suitable basis weights for such tissue webs can be from about 5 to about 40 pounds per 2880 square feet. The webs can be layered or unlayered (blended). The fibers making up the web can be any fibers suitable for papermaking. For most papermaking fabrics, however, hardwood fibers are especially suitable for this process, as their relatively short length maximizes debonding rather than molding during the wet-straining operation. The wet-straining process can be used for either layered or homogeneous webs.

In carrying out the method of this invention, the change in Debonded Void Thickness of the web when subjected to the wet-straining step can be about 5 percent or greater, more preferably about 10 percent or greater, and suitably from about 15 to about 75 percent.

DETAILED DESCRIPTION OF THE INVENTION

Figure 1A:
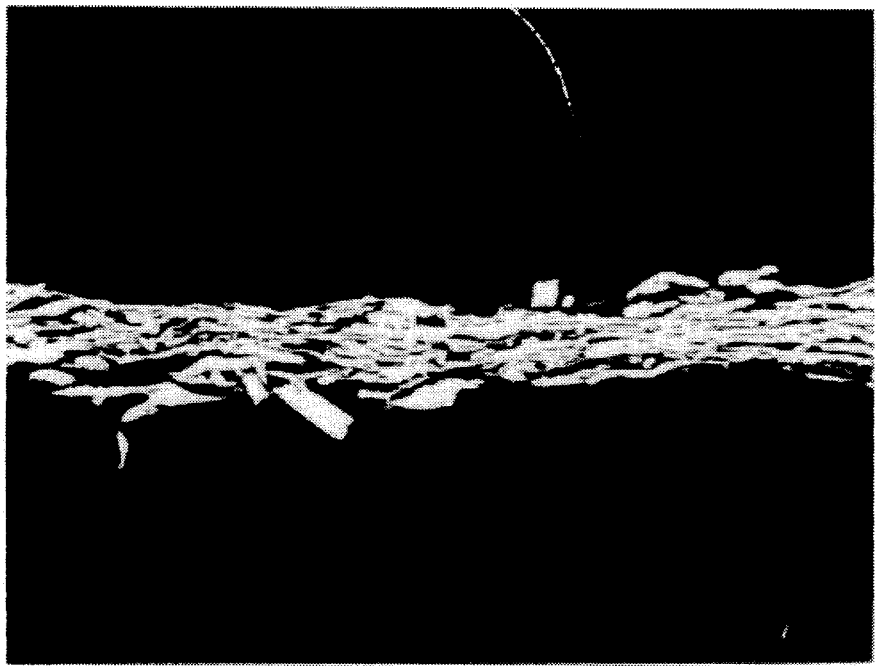
FIGS. 1A and 1B are cross-sectional photographs of a conventional wet-pressed tissue web and a tissue web processed in accordance with this invention, respectively, illustrating the increase in internal bulk resulting from the method of this invention.

Referring to the Drawing, the invention will be described in greater detail. Wherever possible, the same reference numerals are used in the various Figures to identify the same apparatus for consistency and simplicity. In all of the embodiments illustrated, conventional papermaking apparatus and operations can be used with respect to the headbox, forming fabrics, dewatering, transferring the web from one fabric to another, drying and creping, all of which will be readily understood by those skilled in the papermaking art. Nevertheless, these conventional aspects of the invention are illustrated for purposes of providing the context in which the various wet-straining embodiments of this invention can be used.

Figure 1B:
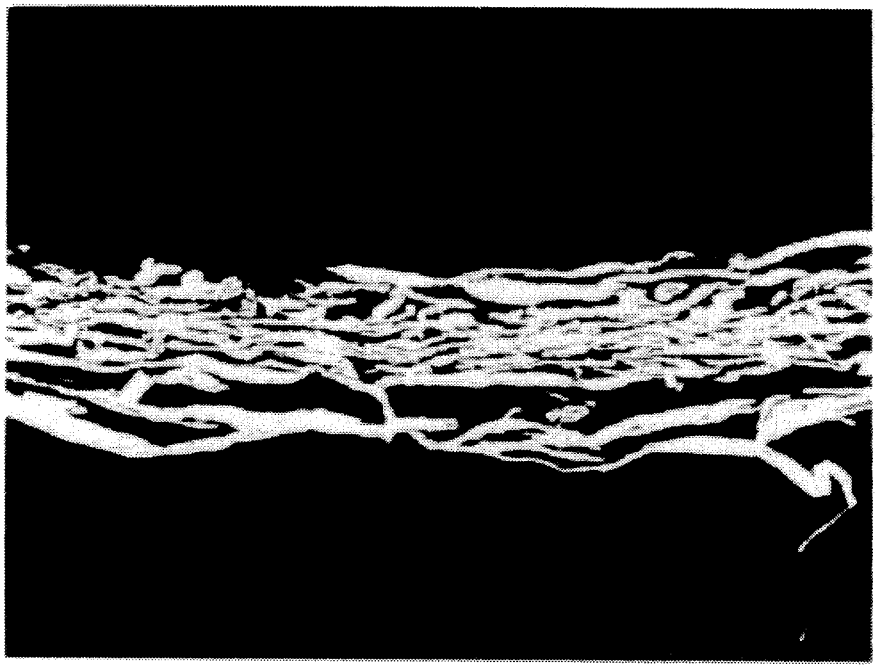

FIGS. 1A and 1B are 150× photomicrographs of handsheets of nominally equal basis weight. The handsheet of FIG. 1A (Sample 1A) was wet-pressed, while the handsheet of FIG. 1G (Sample 1B) was wet-pressed and thereafter wet-strained in accordance with this invention. Both handsheets were made from 50/50 blends of spruce and eucalyptus dispersed in a British Pulp Disintegrator for 5 minutes. Both sheets were then pressed between blotters in an Allis-Chalmers Valley Laboratory Equipment press for 10–15 seconds at 90–95 pounds per square inch gauge (psig) pressure. Sheet consistencies were 56±3 percent. Sample 1A was then dried while sample 1B was wet-strained as described herein and then dried. As the photos illustrate, the wet-straining reduced the density of the sheet yielding a significantly higher caliper. Sample 1A is typical of the structure of wet-pressed sheets while Sample 1B has a more debonded structure having greater internal bulk, similar to a throughdried sheet. The Debonded Void Thickness of Sheet 1A was 31.5 microns compared to 38.9 microns for Sheet 1B. Normalizing using basis weight led to Normalized Debonded Void Thickness values of 138.2 microns per gram and 169.9 microns per gram, respectively. The 23 percent increase in Normalized Debonded Void Thickness with only a 14 percent reduction in tensile strength (from 1195 grams per inch of sample width to 1029 grams) illustrates the improvement provided by wet-straining.

Figure 2:
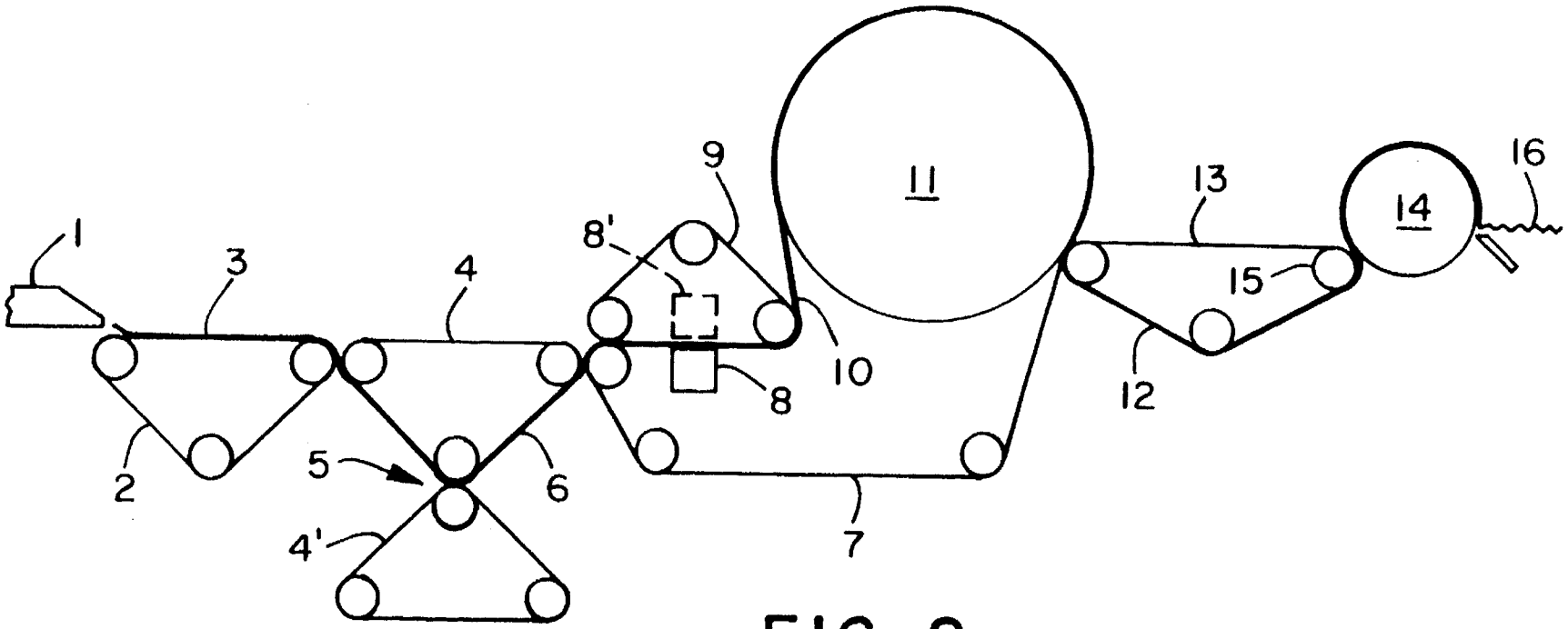
FIGS. 2–7 are schematic flow diagrams of different aspects of the method of this invention referred to above.

FIG. 2 illustrates a combination throughdried/wet-pressed method of making creped tissue in accordance with this invention. Shown is a headbox 1 which deposits an aqueous suspension of papermaking fibers onto an endless forming fabric 2 through which some of the water is drained from the fibers. The resulting wet web 3 retained on the surface of the forming fabric has a consistency of about 10 percent. The wet web is transferred to a papermaking felt 4 and further dewatered in a press nip 5 formed between felt 4 and a second felt 4'. The press nip further dewaters the wet web to a consistency of about 30 percent or greater. The dewatered web 6 is then transferred to a coarse mesh throughdrying fabric 7 and wet-strained with vacuum source 8 positioned underneath the throughdrying fabric to abruptly deflect some of the fibers in the web into the open areas or depressions in the throughdrying fabric and thereby partially debond the web and increase its caliper or thickness. Also shown is an optional wet-straining station comprising a coarse mesh fabric 9 and a vacuum source 8', which can be used in addition to the other wet straining operation or as a replacement therefor. Providing two wet-straining stations provides added flexibility in the use of two different coarse mesh fabrics, which can be utilized to wet-strain the web independent of the desired throughdrying fabric. The wet-straining stations can operate on the web simultaneously or in sequence. In addition, in all of the embodiments shown herein, the wet-straining vacuum sources can be assisted by providing a high pressure air source which directs an air stream onto the opposite side of the web, thereby providing a further increase in pressure differential across the coarse fabric and increasing the driving force to deflect fibers into the coarse fabric.

The wet-strained web 10 is then carried over the throughdrying cylinder 11 and preferably dried to a consistency of from about 85 percent to about 95 percent. The dried web 12 is then transferred to an optional transfer fabric 13, which can be either fine or coarse, which is used to press the web against the surface of the Yankee dryer 14 with pressure roll 15 to adhere the web to the Yankee surface. The web is then completely dried, if further drying is necessary, and dislodged from the Yankee with a doctor blade to produce a creped tissue 16.

Figure 3:
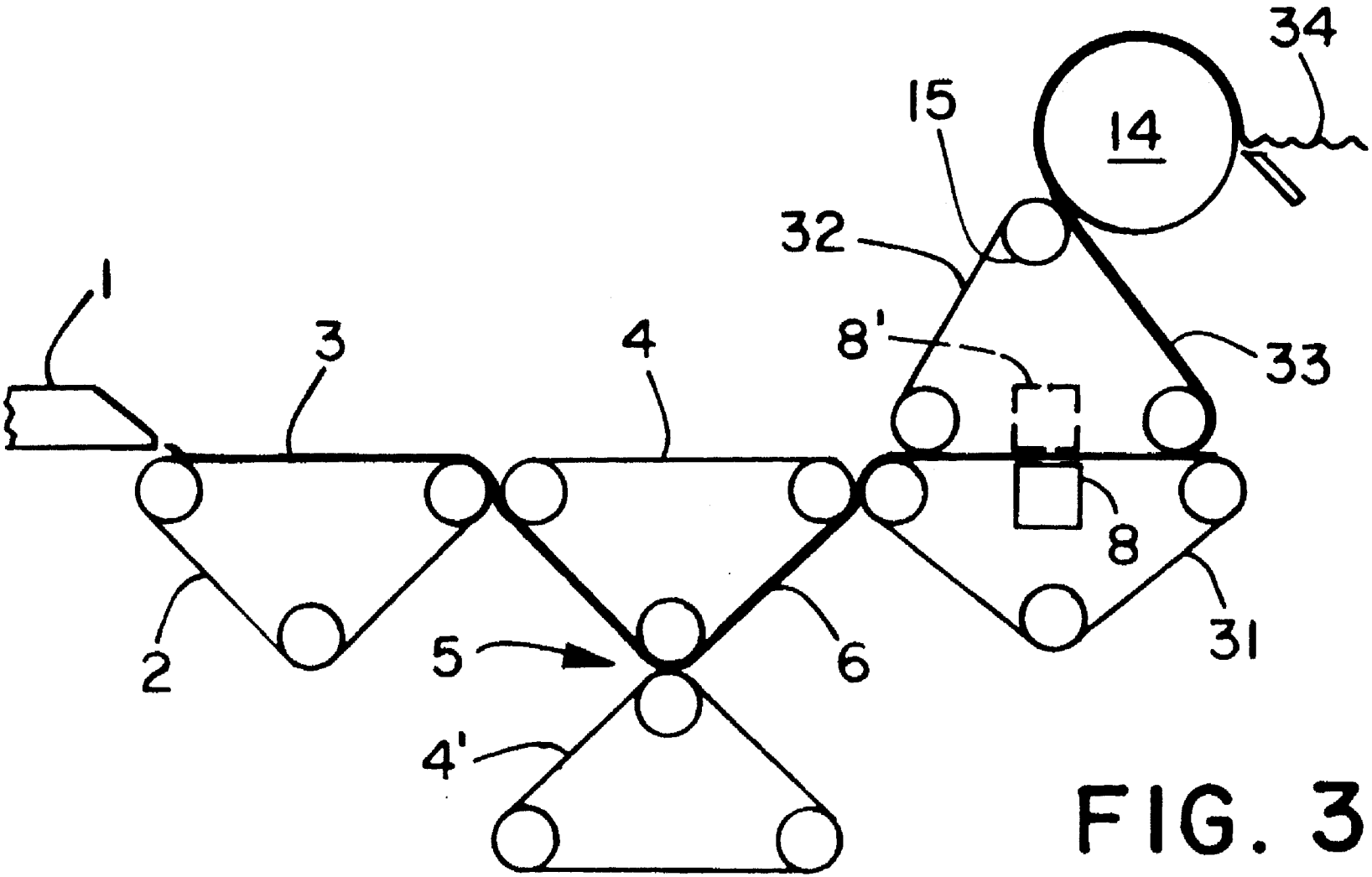

FIG. 3 illustrates a wet-press method of this invention in which a throughdryer is not used. Shown is a headbox 1 which deposits an aqueous suspension of papermaking fibers onto a forming fabric 2 to form a wet web having a consistency of about 10 percent. The wet web is transferred to a papermaking felt 4 and further dewatered in a press nip 5 formed between felt 4 and a second felt 4'. The dewatered web 6 is then transferred to a coarse mesh fabric 31 and wet-strained using vacuum source 8 before transferring to fabric 32. Optionally, a vacuum source 8' can be utilized in addition to vacuum source 8 or in place of vacuum source 8. If used in addition to vacuum source 8, additional wet-straining can be achieved. If the coarseness of fabric 32 is different than that of fabric 31 or if the mesh openings of the two fabrics do not coincide, areas of the web not strained by the first vacuum source can be strained by the second vacuum source. In any event, the second vacuum source acts upon the opposite side of the web to achieve additional straining and debonding of the web. Wet-straining from both sides of the web can be particularly advantageous if layered webs are present, especially if the outer layers are more susceptible to debonding than the inner layer(s). As previously mentioned, a predominance of hardwood fibers in the outer layer lends itself well to wet-straining. The wet-strained web 33 is then transferred to the surface of Yankee dryer 14 using pressure roll 15 and dislodged by doctor blade (creped), resulting in creped tissue 34.

Figure 4:
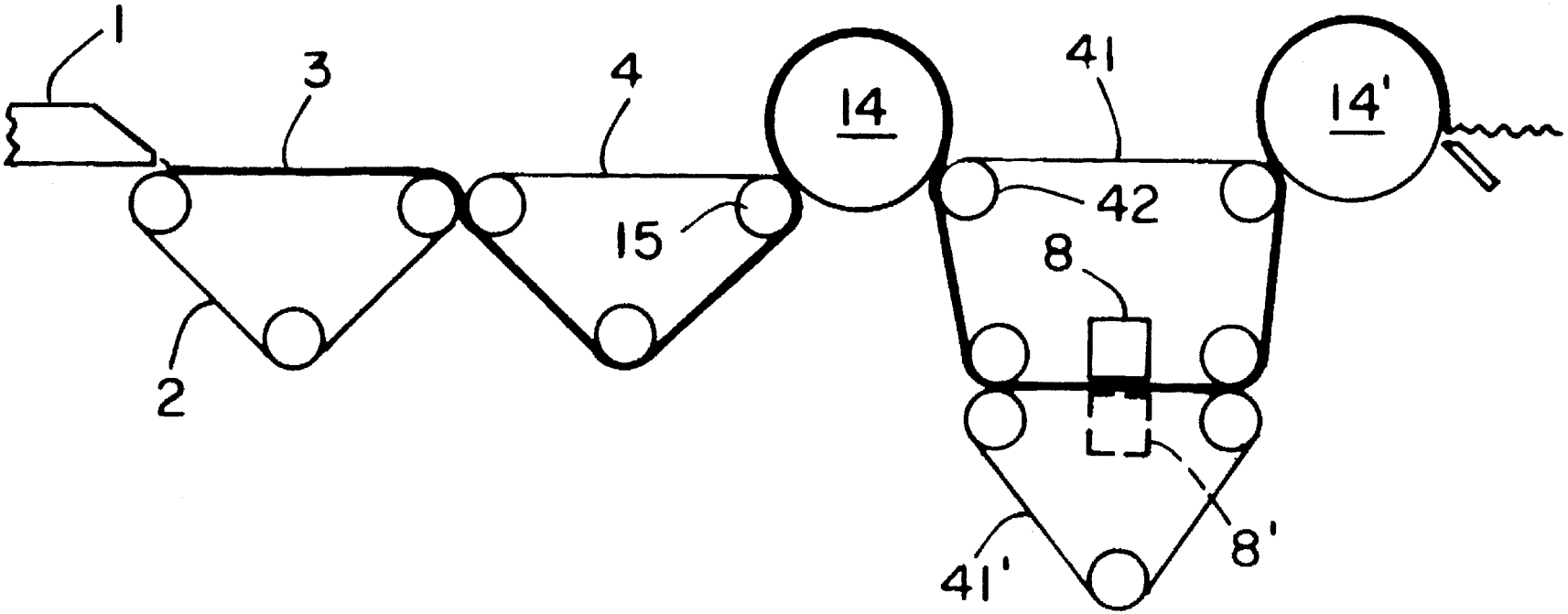

FIG. 4 illustrates a method of this invention utilizing two dryers in series with wet-straining in between. Shown is a headbox 1 which deposits the aqueous suspension of papermaking fibers onto a forming fabric 2 to form a wet web 3 having a consistency of about 10 percent. The wet web is transferred to a papermaking felt 4 and further dewatered and pressed onto the surface of Yankee dryer 14 using pressure roll 15. The consistency of the web after transfer to the surface of the Yankee is preferably about 40 percent. (The Yankee can optionally be replaced by a throughdryer, which would require transfer of the web from the felt 4 to a throughdryer fabric or replacement of the felt with a throughdryer fabric, not shown.) The Yankee (or the throughdryer) serves to partially dry the dewatered web to a consistency of preferably from about 50 to about 70 percent. The partially-dried web is then transferred to a coarse mesh fabric 41 with the assistance of vacuum suction roll 42 and wet-strained using vacuum source 8. Optionally, the web can be sandwiched between fabric 41 and another coarse fabric 41" and further wet-strained using a second vacuum source 8". The second vacuum source can be applied to the web simultaneously with vacuum source 8 to simultaneously act upon both sides of the web, or the second vacuum source can be applied upstream or downstream of the first vacuum source to sequentially act upon opposite sides of the web. In any event, the application of two or more vacuum straining sources is expected to provide more uniform debonding of the web. After wet-straining, the web is transferred to a Yankee dryer 14' for final drying and creped to yield a creped tissue web.

Figure 5:
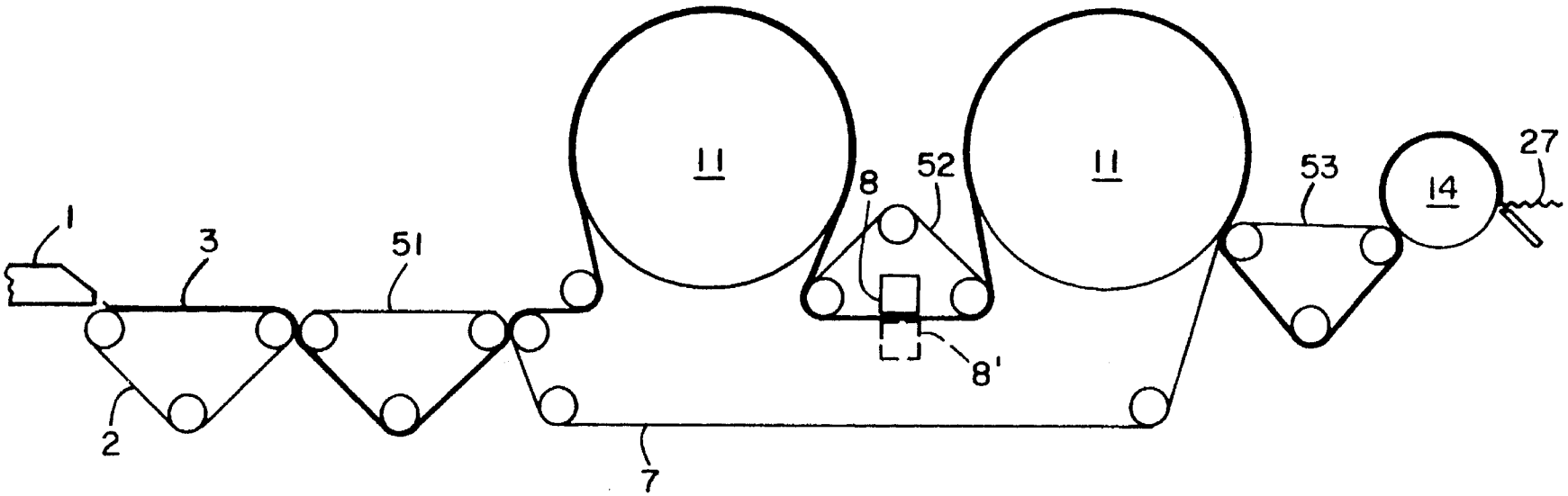

FIG. 5 illustrates another embodiment of this invention in which two throughdryers are used to dry the web. Shown is the headbox 1 which deposits the aqueous suspension of papermaking fibers onto the surface of forming fabric 2. The wet web 3 is transferred to an optional fine mesh transfer fabric 51 and thereafter transferred to a coarse mesh throughdryer fabric 7. The web is then partially dried in the first throughdryer 11 to a consistency of preferably about 45 percent. The partially dried web is then sandwiched between the throughdryer fabric 7 and coarse mesh fabric 52 and wet-strained using vacuum source 8. (For purposes herein, bringing a web into contact with a coarse mesh fabric, such as sandwiching the web against the coarse mesh fabric 52, is considered "transferring" the web to the coarse mesh fabric, even though the web continues to travel with a different fabric, such as the throughdryer fabric in this case.) Optionally, the web can be simultaneously or subsequently wet-strained from the opposite direction on the throughdryer fabric to further debond the web.

After wet-straining, the web is carried over a second throughdryer 11' and further dried to a consistency of preferably about 85 to about 95 percent, transferred to a fine mesh fabric 53, and pressed onto the surface of a Yankee dryer 14 for final drying, if necessary, and creping to produce creped web 27. In the case of final drying on the second throughdryer, transfer to the Yankee for creping is an option. It is within the scope of this invention that whenever a throughdryer is used to dry the web, the final product can be uncreped.

Figure 6:
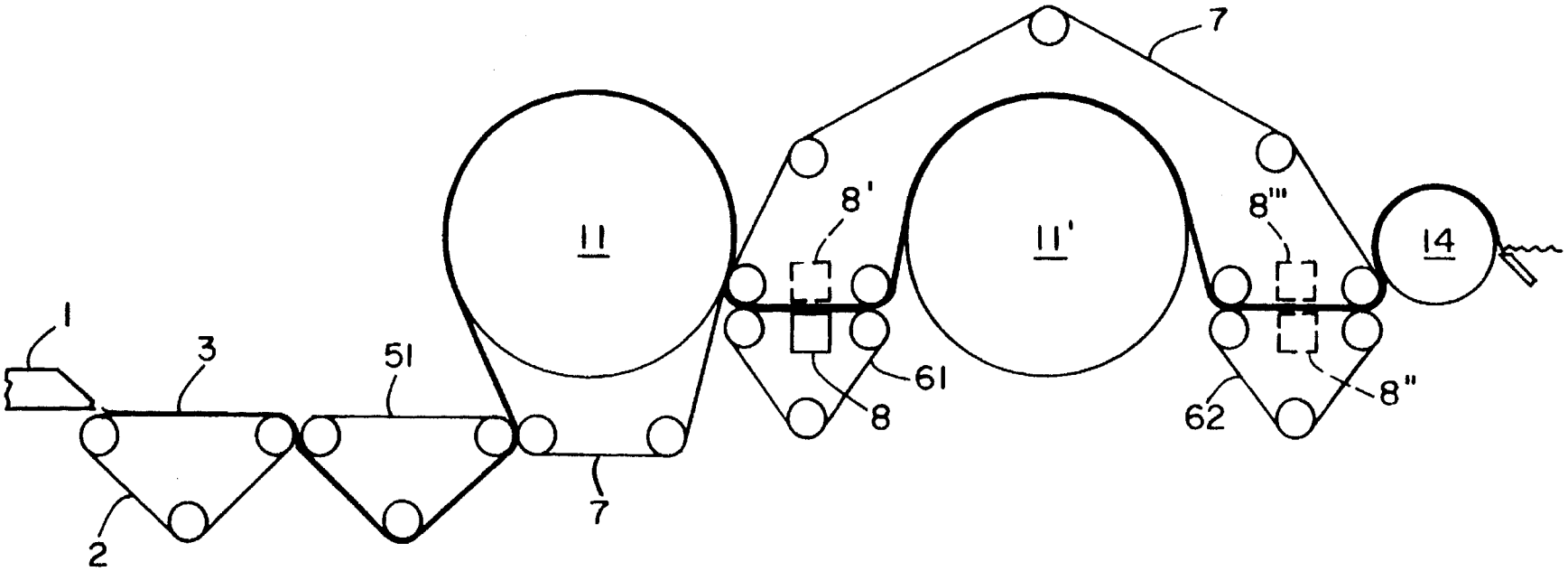

FIG. 6 illustrates a similar process to that of FIG. 5, but using two throughdrying fabrics. Shown is the headbox 1 depositing the aqueous suspension of papermaking fibers onto the surface of the forming fabric 2. The web 3 is transferred to optional fine mesh fabric 51 and thereafter transferred to throughdrying fabric 7. The web is carried over the first throughdryer 11 and partially dried to a consistency of preferably about 45 percent. The partially dried web is then transferred to a second throughdryer fabric 7' and sandwiched between the second throughdryer fabric and coarse fabric 61. Vacuum source 8 is used to wet-strain and partially debond the web as previously described. Optionally, the web can be wet-strained from the opposite direction using alternative vacuum source 8', either in addition to or in place of vacuum source 8. The web is then further dried in a second throughdryer 11', transferred to a Yankee 14 and creped. Optionally, the web can be wet-strained using optional vacuum sources 8" and 8'". If vacuum source 8" is used, a coarse fabric 62 is used to provide the depressions into which the fibers in the web are deflected.

Figure 7:
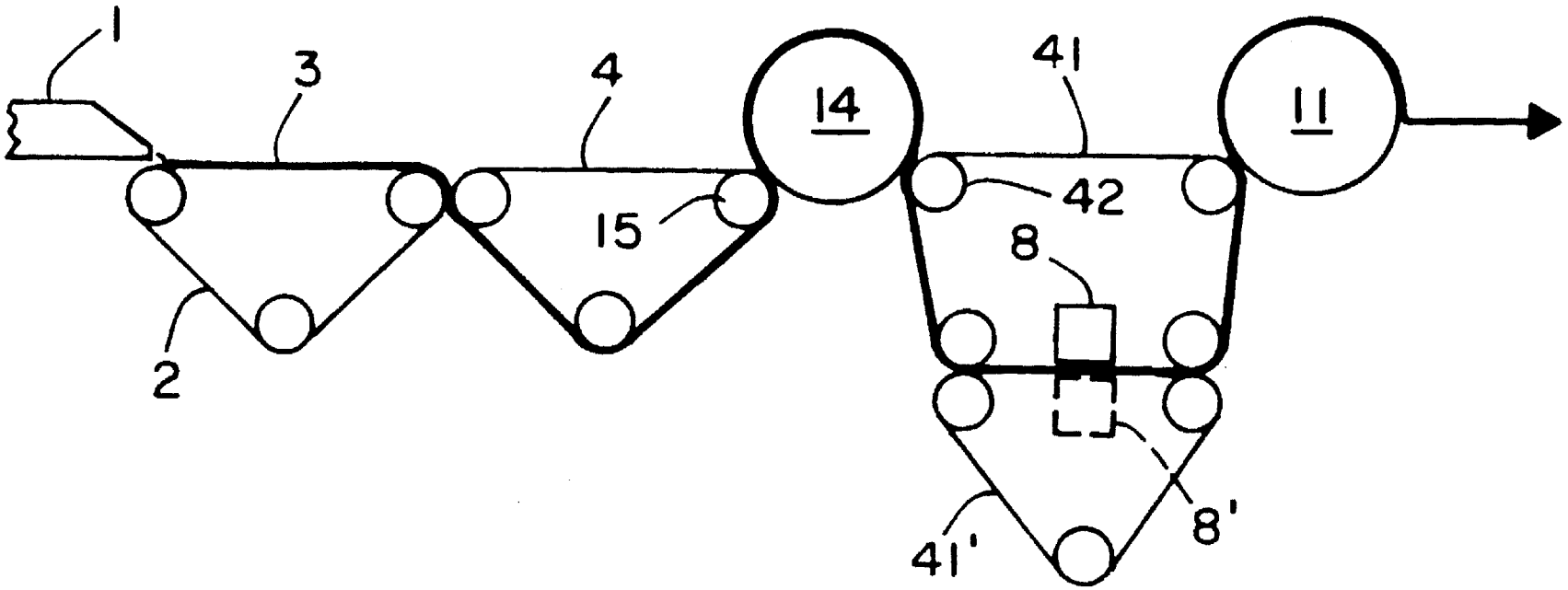

FIG. 7 illustrates another embodiment of this invention, similar to that illustrated in FIG. 4, but using a throughdryer 11 to final dry the web.

Figure 8:
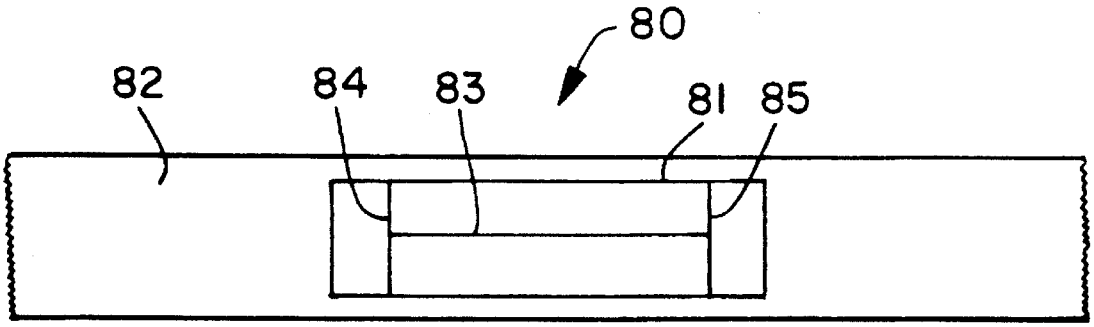
FIGS. 8–13 pertain to the method of determining the Debonded Void Thickness of a sample.

FIGS. 8–14 pertain to the method for determining the Debonded Void Thickness, which is described in detail below. Briefly, FIG. 8 illustrates a plan view of a specimen sandwich 80 consisting of three tissue specimens 81 sandwiched between two transparent tapes 82. Also shown is a razor cut 83 which is parallel to the machine direction of the specimen, and two scissors cuts 84 and 85 which are perpendicular to the machine direction cut.

Figure 9:
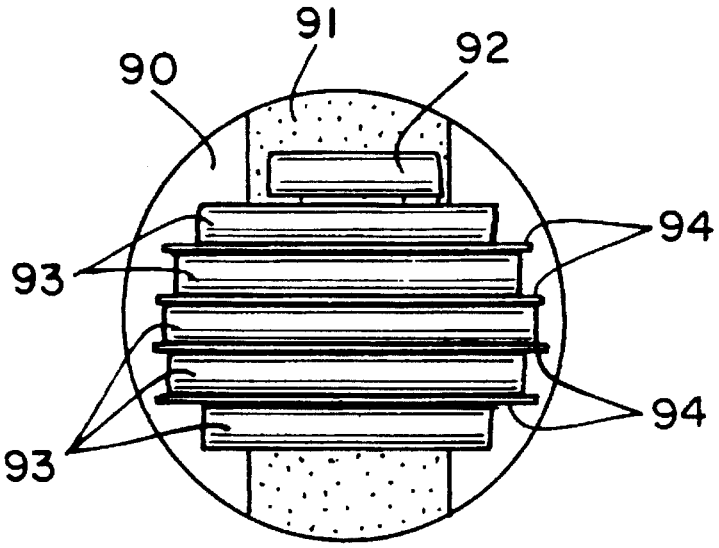

FIG. 9 illustrates a metal stub which has been prepared for sputter coating. Shown is the metal stub 90, a two-sided tape 91, a short carbon rod 92, five long carbon rods 93, and four specimens 94 standing on edge.

Figure 10:
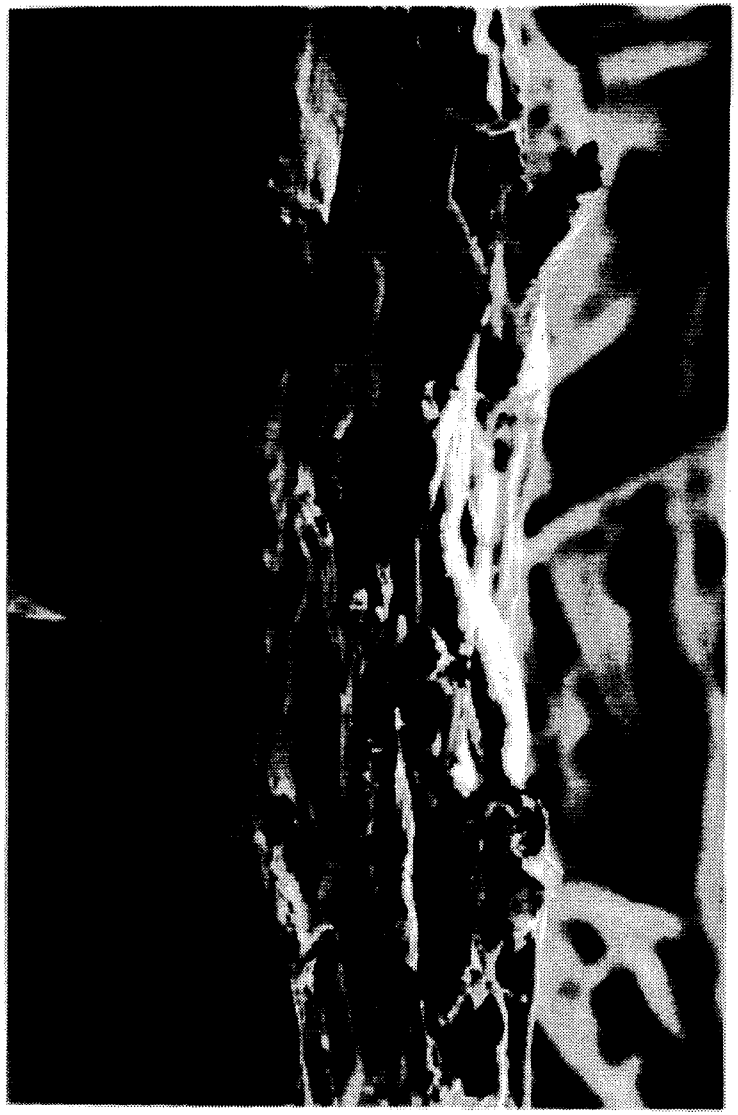

FIG. 10 shows a typical electron cross-sectional photograph of a sputter coated tissue sheet using Polaroid® 54 film.

Figure 11A:
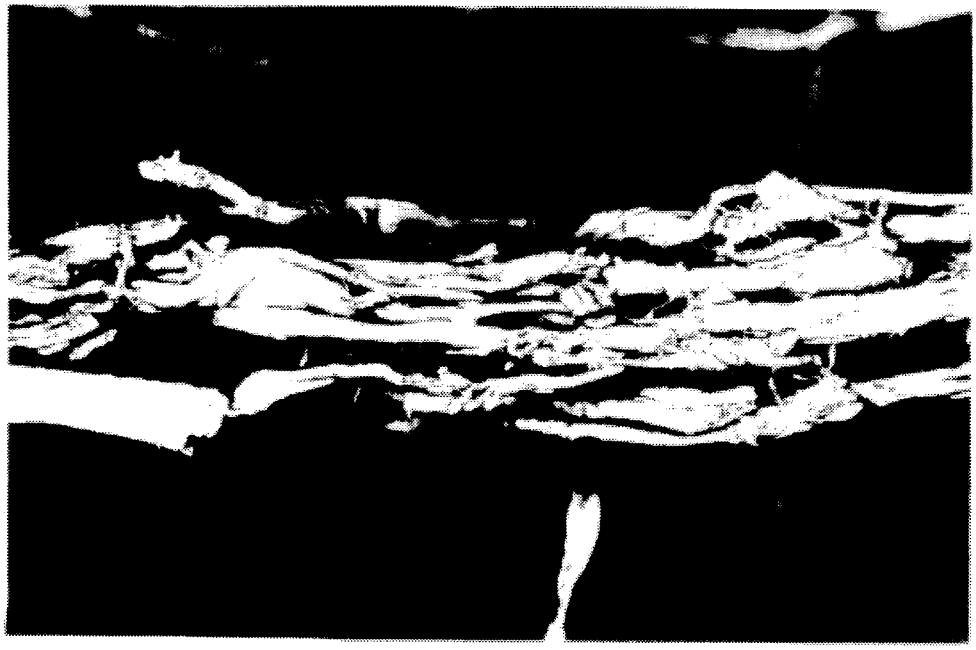

FIG. 11A shows a cross-sectional photograph of the same tissue sheet as shown in FIG. 10, but using Polaroid 51 film. Note the greater black and white contrast between the spaces and the fibers.

Figure 11B:
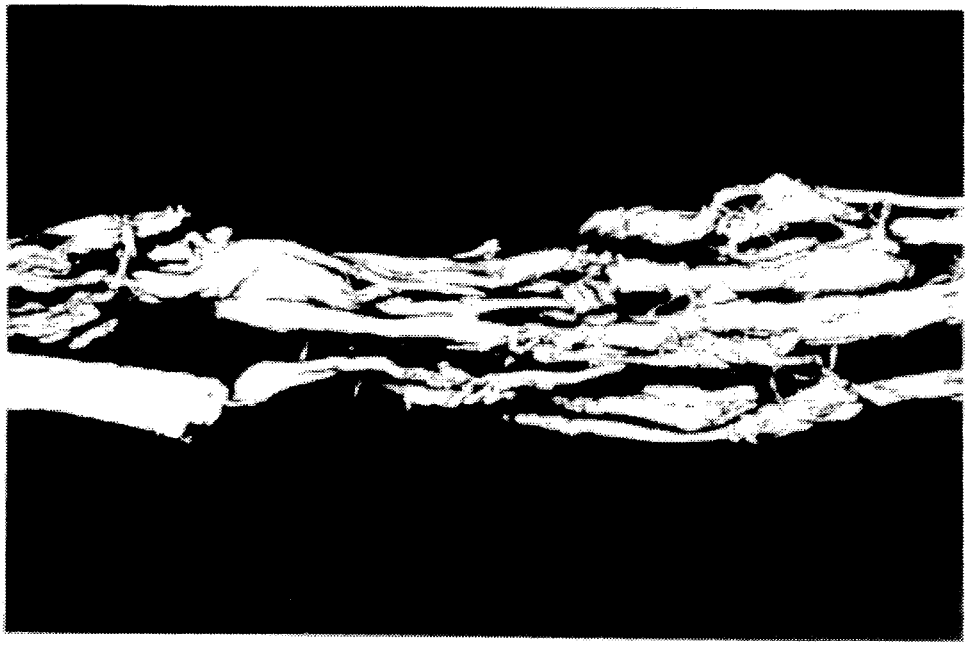

FIG. 11B is the same photograph as that of FIG. 11A, except the extraneous fiber portions not connected or in the plane of the cross-section have been blacked out in preparation for image analysis as described herein.

Figure 12:
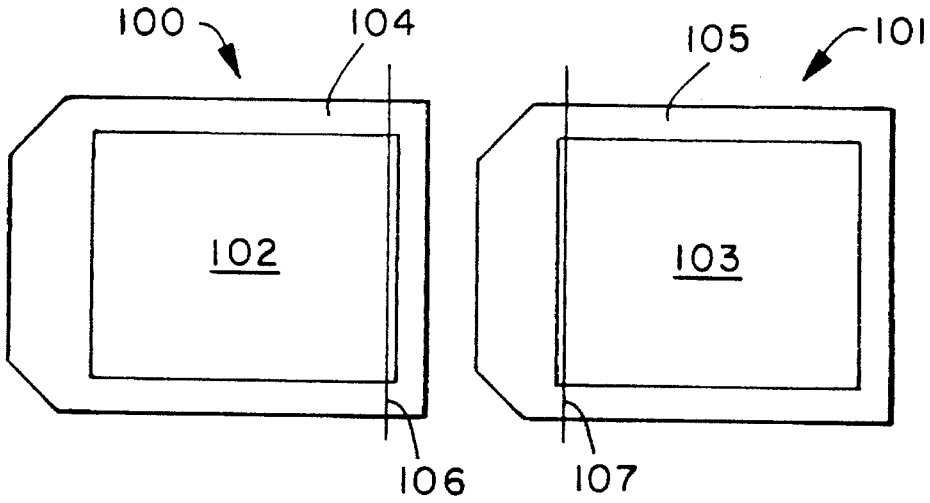

FIG. 12 shows two Scanning Electron Micrograph (SEM) specimen photographs 100 and 101 (approximately ½ scale), illustrating how the photographs are trimmed to assemble a montage in preparation for image analysis. Shown are the photo images 102 and 103, the white border or framing 104 and 105, and the cutting lines 106 and 107.

Figure 13:
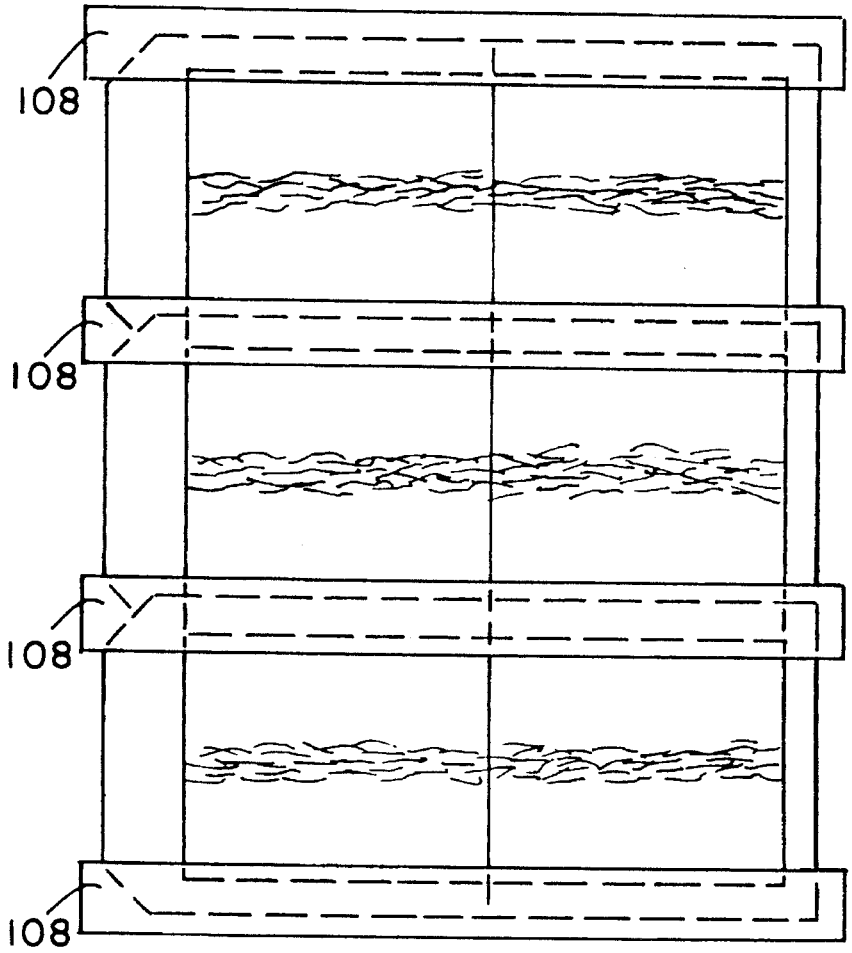

FIG. 13 shows a montage of six photographs (approximately ½ scale) in which the white borders of the photographs are covered by four strips of black construction paper 108.

Figure 14:
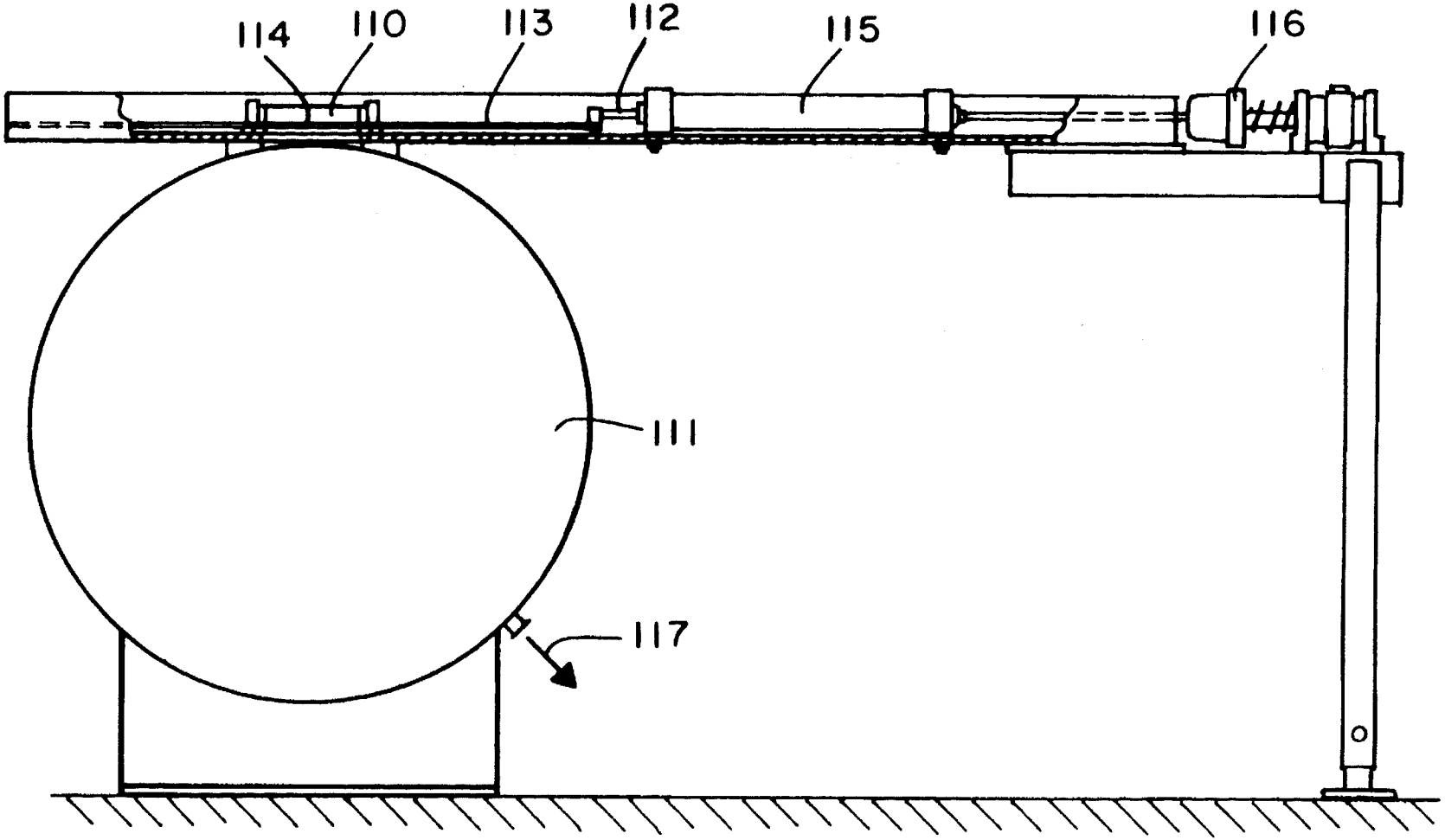
FIG. 14 is a schematic illustration of the apparatus used to wet strain handsheets in the Examples.

FIG. 14 is a schematic illustration of the apparatus used to wet strain sample handsheets as described in the Examples. Shown is a sample holder 110 which contains an Asten 934 throughdrying fabric. The sample holder is designed to accept a similarly sized handsheet mold in which the handsheet sample is formed and supported by a suitable forming fabric. Also shown is a vacuum tank 111, a slideable rod 112 connected to a slideable "sled" 113 having a ¼ inch (0.63 centimeters) wide slot 114 through which vacuum is applied to the sample, a pneumatic cylinder 115 for propelling the sled underneath the sample, and a shock absorber 116 for receiving and stopping the rod. In operation, the vacuum tank is evacuated as indicated by arrow 117 to the desired vacuum level via a suitable vacuum pump. The handsheet, while still in the handsheet mold and having one side is still in contact with the forming fabric of the handsheet mold and at the desired consistency, is placed "upside down" in the sample holder of the illustrated apparatus such that the other side of the handsheet is in contact with the throughdryer fabric of the sample holder. The pneumatic cylinder is then pressurized with nitrogen gas to cause the rod 112 and the connected sled 113 to move at a controlled speed toward the shock absorber at the end of the apparatus. In so doing, the slot in the sled briefly passes under the sample holder as shown and thereby briefly subjects the sample to the vacuum, thereby mimicking a continuous process in which the tissue is moving and the vacuum slot is fixed. The brief exposure to vacuum wet strains the sample as it is transferred to the throughdrying fabric in the sample holder. The handsheet is then dried to final dryness while supported by the throughdrying fabric by any suitable noncompressive means such as throughdrying or air drying. In all of the examples described herein, the speed of the sled was 2000 feet per minute (10.1 meters per second) and the level of vacuum was 25 inches of mercury.

Debonded Void Thickness

The method for determining the Debonded Void Thickness (DVT) is described below in numerical stepwise sequence, referring to FIGS. 8–13 from time to time. In general, the method involves taking several representative cross-sections of a tissue sample, photographing the fiber network of the cross-sections with a scanning electron microscope (SEM), and quantifying the spaces between fibers in the plane of the cross-section by image analysis. The total area of spaces between fibers divided by the frame width is the DVT for the sample.

A. Specimen Sandwiches

1. Samples should be chosen randomly from available material. If the material is multi-ply, only a single ply is tested. Samples should be selected from the same ply position. The same surface is designated as the upper surface and samples are stacked with the same surface upwards. Samples should be kept at 30° C. and 50 percent relative humidity throughout testing.

2. Determine the machine direction of the sample, if it has one. The cross-machine direction of the sample is not tested. The cross-section will be cut such that the cut edge to be analyzed is parallel to the machine direction. For strained handsheets the cut is made perpendicular to the wire knuckle pattern.

3. Place about five inches (127 millimeters) of tape (such as 3M Scotch™ Transparent Tape 600 UPC 021200-06943), ¾ inch (19.05 millimeters) width, on a working surface such that the adhesive side is uppermost. (The tape type should not shatter in liquid nitrogen).

4. Cut three ⅝ inch (or 15.87 millimeters) wide by about 2" (or 50.8 millimeters) long specimens from the sample such that the long dimension is parallel to the machine direction.

5. Place the specimens on the tape in an aligned stack such that the borders of the specimens are within the tape borders (see FIG. 8). Specimens which adhere to the tape will not be usable.

6. Place another length of tape of about 5 inches (or 127 millimeters) on top of the stack of specimens with the adhesive side towards the specimens and parallel to the first tape.

7. Mark on the upper surface of the tape which is the upper surface of the specimen.

8. Make twelve specimen sandwiches. One photo will be taken for each specimen.

B. Liquid Nitrogen Sample Cutting

Liquid nitrogen is used to freeze the specimens. Liquid nitrogen is dispensed into a container which holds the liquid nitrogen and allows the specimen sandwich to be cut with a razor blade while submerged. A VISE GRIP™ pliers can hold the razor blade while long tongs secure and hold the specimen sandwich. The container is a shallow rigid foam box with a metal plate in the bottom for use as a cutting surface.

1. Place the specimen sandwich in a container which has enough liquid nitrogen to cover the specimen. Also place the razor blade in the container to adjust to temperature before cutting. A new razor blade must be used for each sandwich to be cut.

2. Grip the razor blade with the pliers and align the cutting edge length with the length of the specimen such that the razor blade will make a cut that is parallel with the machine direction. The cut is made in the middle of the specimen. (See FIG. 8).

3. The razor blade must be held perpendicular to the surface of the specimen sandwich. The razor blade should be pushed downward completely through the specimen sandwich so that all layers are cleanly cut.

4. Remove the specimen sandwich from the liquid nitrogen.

C. Metal Stub Preparation

1. The metal stubs' dimensions are dictated by the parameters of the SEM. The dimensions as illustrated in FIG. 9 are about 22.75 millimeters in diameter and about 9.3 millimeters thick.

2. Label back/bottom of stub with the specimen name.

3. Place a length of two-sided tape (3M Scotch™ Double-Coated Tape, Linerless 665, ½ inch [or about 12.7 millimeters] wide) across the diameter of the stub. (See FIG. 9).

4. Place about a ¼" (or about 6.35 millimeters) length of ⅛ inch (or about 3.17 millimeters) diameter carbon rod (manufacturer: Ted Pella, Inc., Redding, Calif., ⅛ [or 3.17 millimeters] diameter by 12-inch [or 304.8 millimeters] length, Cat. #61-12) at one end of the tape within the edges of the stub such that its length is perpendicular to the length of the tape. This marks the top of the stub and the upper surface of the specimen.

5. Place a longer rod below the short rod. The length of the rod should not extend beyond the edge of the stub and should be approximately the length of the specimen.

6. Cut the specimen sandwich perpendicular to the razor cut at the ends of the razor cut (see FIG. 8).

7. Remove the inner specimen and place standing up next to (and touching) the carbon rod such that its length is parallel to the rod's length and its razor cut edge is uppermost. The upper surface of the specimen should face the small carbon rod.

8. Place another carbon rod approximately the length of the specimen next to the specimen such that it is touching the specimen. Again, the rod should not extend beyond the disk edges.

9. Repeat specimen, rod, specimen, rod until the metal stub is filled with four specimens. Three stubs will be used for the procedure.

D. Sputter Coating the Specimen

1. The specimen is sputter coated with gold (Balzar's Union Model SCD 040 was used). The exact method will depend on the sputter coater used.

2. Place the sample mounted on the stub in the center of the sputter coater such that the height of the sample edge is about in the middle of the vacuum chamber, which is about 1¼ inches (or 31.75 millimeters) from the metal disk.

3. The vacuum chamber arm is lowered.

4. Turn the water on.

5. Open the argon cylinder valve.

6. Turn the sputter coater on.

7. Press the SPUTTERING button twice. Set the time using SET and FAST buttons. Three minutes will allow the specimen to be coated without over-coating (which could cause a false thickness) or under coating (which could cause flaring).

8. Press the STOP button once so it is flashing. Press the TENSION button at this time. The reading should be 15–20 volts. Hold the TENSION button down and press CURRENT UP and hold. After about a ten-second delay, the reading will increase. Set to approximately 170–190 volts. The current will not increase unless the STOP button is flashing.

9. Release the TENSION and CURRENT UP buttons as you turn the switch on the arm to the green dot to open the window. The current should read about 30 to 40 milliamps.

10. Press the START button.

11. When completed, close the window on the arm and turn the unit off. Turn off the water and argon. Allow the unit to vent before the specimen is removed.

E. Photographing with the SEM (JEOL, JSM 840 II, distributed by Japanese Electro Optical Laboratories, Inc. located in Boston, Mass.). A clear, sharp image is needed. Several variables known to those skilled in the art of microscopy must be properly adjusted to produce such an image. These variables include voltage, probe current, F-stop, working distance, magnification, focus and BSE Image wave form. The BSE wave form must be adjusted up to and slightly beyond the reference limit lines in order to obtain proper black-&-white contrast in the image.

These variables are adjusted to their optimum to produce the clear, sharp image necessary and individual adjustments are dependent upon the particular SEM being used. The SEM should have a thermatic source (tungsten or Lab 6) which allows large beam current and stable emission. SEMs which use field emission or which do not have a solid state back scatter detector are not suitable.

1. Load the stub such that the specimen's length is perpendicular to the tilt direction and lowered as far as possible into the holder so that the edge is just above the holder. Scan rotation may be necessary depending on the SEM used.

2. Adjust the working distance (39 millimeters was used). The specimen should fill about ⅓ of the photo area, not including the mask area. (For handsheets, a magnification of 150× was used.)

3. Use the tilt angle of the SEM unit to show the very edge of the specimen with as little background fibers as possible. Do not select areas that have long fibers that extend past the frame of the photo.

4. One photomicrograph is taken using normal film (POLAROID 54) for gray levels for comparison. The F-stop may vary. The areas selected should be representative and not include long fibers that extend beyond the vertical edge of the viewing field.

5. Without moving the view, take one photomicrograph using back scatter electrons with high contrast film (51 Polaroid). The F-stop may vary. A sharp, clear image is needed. After the photomicrographs are developed, a black permanent marker is used to black out background fibers that are out of focus and are not on the edge of the specimen. These can be selected by comparing the photomicrograph to the gray level photomicrograph of Step 4 above. (See FIGS. 10 and 11.)

6. A total of twelve photomicrographs are taken to represent different areas of the specimens; one photomicrograph is taken of each specimen.

7. A protective coating is applied to the photo on 51 film.

F. Image Analysis of SEM Photos

1. The 12 photos are arranged into two montages. Six photos are used in each montage. Make two stacks of six photos each, and cut the white framing off the left side of one and the white framing off the right side of the remaining stack without disturbing the photos. (See FIG. 12.)

2. Then, taking one photo from each stack, place cut edges together and tape together with the tape on the back of the photo (3M Highland™ Tape, ¾ inch [or 19.05 millimeters]). No extraneous white of the background should show at the cut, butted edges.

3. Arrange the photos with a small overlap from top to bottom as in FIG. 13.

4. Turn on the image analyzer (Quantimet 970, Cambridge Instruments, Deerfield, Ill.). Use a 50 mm. El-Nikkor lens with C-mount adaptor (Nikon, Garden City, New York) on the camera and a working distance of about 12 inches (305 millimeters). The working distance will vary to obtain a sharp clear image on the monitor and the photo. Make sure the printer is on line.

5. Load the program (described below).

6. Calibrate the system for the photo magnification (which will generate the calibration values indicated by "x.xxxx" in the program listed below), set shading correction with white photo surface (undeveloped x-ray film), and initialize stage (12 inches by 12 inches open frame motor-driven stage (auto stage by Design Components, Inc., Franklin, Massachusetts)) with step size of 25 microns per step.

7. Load one of the two photo montages under a glass plate supported on the stage after strips of black construction paper are placed over the white edges of the photos. The strips are ¾ inch wide (18.9 millimeter) and 11 inches long (279 millimeters) and are placed as in FIG. 13 so that they do not cover the image in the photo. The montage is illuminated with four 150 watt, 120 volt GE reflector flood lamps positioned with two lamps positioned at an angle of about 30° on each side of the montage at a distance of about 21 inches (533 millimeters) from the focus point on the montage.

8. Adjust the white level to 1.0 and the sensitivity to about 3.0 (between 2 and 4) for the scanner using a variable voltage transformer on the flood lamps.

9. Run the program. The program selects twelve fields of view: two per photomicrograph.

10. Repeat at the pause with the second montage after completion of twelve fields of view on the first montage.

11. A printout will give the Debonded Void Thickness.

G. Computer Program

```
  Enter specimen identity
Scanner (No. 2 Chalnicon LV = 0.00 SENS = 1.64 PAUSE)
Load Shading Corrector (pattern - OFOSU3)
Calibrate User Specified (Calibration Value = x.xxxx microns per pixel)
                (PAUSE)
CALL STANDARD
TOTDEBARE : = 0.
For SAMPLE = 1 to 2
Stage Scan    (                    X        Y
                scan origin     10000.0  10000.0
                field size      16500.0  11000.0
                no. of fields     3        4    )
Detect 2D (Lighter than 32 PAUSE)
For FIELD
Scanner (No. 2 Chalnicon AUTO-SENSITIVITY LV = 0.00)
Live Frame is Standard Live Frame
Detect 2D (Lighter than 32)
Amend (OPEN by 1)
Measure field - Parameters into array FIELD
RAWAREA: = FIELD AREA
Amend (CLOSE by 20)
Image Transfer from Binary B (FILL HOLES) to Binary Output
Measure field - Parameters into array FIELD
FILLAREA: = FIELD AREA
DEBNAREA: = FILLAREA – RAWAREA
TOTDEBARE: = TOTDEBARE + DEBNAREA
Stage Step
Next FIELD
Pause
Next
FIELDNUM: = FIELDNUM * (SAMPLE - 1.)
Print " "
Print "DEBOND VOID THICKNESS =", ( TOTDEBARE / FIELDNUM)/(625.* CAL.CONST )
Print " "
For LOOPCOUNT = 1 to 7
Print " "
Next
End of Program
```

EXAMPLES

In order to further illustrate the invention, a number of handsheets were prepared as follows:

The pulp was dispersed for five minutes in a British pulp disintegrator. Circular handsheets of four-inch diameter, conforming precisely to the dimensions of the sample holder used for wet-straining, were produced by standard techniques. The sample holder contained a 94-mesh forming fabric on which the handsheets were formed. After formation the handsheets were at about 5 percent consistency. For those samples not wet-pressed (Example 1), the samples were dried to the consistency selected for wet-straining by means of a hot lamp and then wet-strained. For those experiments involving pressing (Example 2), the handsheet was removed from the sample holder by couching with a dry blotter. The sheet was then pressed in an Allis-Chalmers Valley Laboratory Equipment press. Pressing time and/or pressure were varied to achieve the desired post-pressing consistency. Selected samples were then wet-strained.

Wet-straining of the handsheets was performed using the apparatus previously described in reference to FIG. 14. In all cases, a sample holder containing an Asten 934 throughdrying fabric was placed in the wet-straining apparatus. When the base sheet reached the desired consistency, either by pressing or drying with the lamp, the holder on which the sheet was formed was placed "upside down" in the straining apparatus such that the surface of the sheet not in contact with the forming fabric came in contact with the surface of the throughdrying fabric. A sled was then caused to slide underneath the sample holders exposing the sheet to vacuum, causing the sheet to be wet-strained and transferred to the throughdrying fabric. In all cases, a sled speed of 2000 fpm and a vacuum of 25 inches of mercury were utilized. The sheet, now located on the throughdrying fabric, was then dried to complete dryness in a noncompressive manner.

Example 1

Handsheets were made from a 100 percent eucalyptus furnish and dried with a hot lamp to various consistencies prior to wet-straining as described above. After wet-straining, various physical parameters were measured as shown in TABLE 1 below. (Sample weight is expressed in grams; Consistency is expressed in weight percent; Tensile strength is expressed as grams per inch of sample width; Normalized tensile strength is the tensile strength divided by the sample weight, expressed as reciprocal inches; Debonded Void Thickness is expressed as microns; and Normalized Debonded Void Thickness is the Debonded Void Thickness divided by the sample weight, expressed as microns per gram.)

TABLE 1

| Sample Weight | Consistency Prior to Wet Straining | Tensile | Normalized Tensile | Debonded Void Thickness | Normalized Debonded Void Thickness |
|---|---|---|---|---|---|
| 0.305 | 13.2 | 420 | 1377 | 86.1 | 282.3 |
| 0.235 | 33.6 | 396 | 1685 | 84.1 | 357.9 |
| 0.227 | 46.3 | 255 | 1123 | 82.6 | 363.9 |

For comparison, an air-dried control sample (not wet-strained) weighing 0.238 grams had a tensile strength of 460 grams, a normalized tensile of 1933, a Debonded Void Thickness of 73 microns, and a Normalized Debonded Void Thickness of 306.7 microns per gram.

These results clearly show that wet-straining can be used to increase the void area relative to the weight of the sheet. As the data indicates, conducting the wet-straining at only 13 percent consistency (below the level claimed in this application) did not result in a significant increase in Normalized Debonded Void Thickness. Instead the sheet was primarily molded to the shape of the fabric. However, for the samples wet-strained at higher consistency, a definite increase in the Normalized Debonded Void Thickness was apparent and the tensile strength (a measure of bonding in the sheet) significantly decreased. Hence wet straining becomes effective at approximately 30 percent consistency or greater, with an optimum wet-straining consistency varying with furnish, fabric, etc. However, the optimum consistency is believed to lie in the 40–50 percent range.

Example 2

Handsheets nominally weighing 0.235±0.200 grams were made from a 50/50 blend by weight of eucalyptus and spruce fibers. One set of handsheets was pressed to various consistencies (not wet strained) to serve as a control. Another set was pressed to approximately 50 percent consistency and then wet strained as described above. Consistencies, sample weights and the Debonded Void Areas were measured for each sample. The data is tabulated in TABLE 2 below and further illustrated in FIG. 15. The first six samples listed represent the control samples. The last five samples are the wet-strained samples.

TABLE 2

| Sample Weight | Post Pressing Consistency | Tensile | Normalized Tensile | Debonded Void Thickness | Normalized Debonded Void Thickness |
|---|---|---|---|---|---|
| 0.252 | 30.7 | 662 | 2627 | 73.2 | 290.5 |
| 0.224 | 31 | 760 | 3393 | 56.5 | 252.2 |
| 0.237 | 34.9 | 684 | 2886 | 72.6 | 306.3 |
| 0.241 | 35 | 761 | 3158 | 59.1 | 245.2 |
| 0.228 | 58.5 | 1195 | 5241 | 31.5 | 138.2 |
| 0.229 | 60.3 | 1207 | 5271 | 29 | 126.6 |
| 0.224 | 51.3 | 774 | 3455 | 58.6 | 261.6 |
| 0.246 | 51.5 | 887 | 3606 | 64.2 | 261 |
| 0.23 | 52.6 | 848 | 3687 | 63.1 | 274.3 |
| 0.229 | 54.3 | 1029 | 4493 | 38.9 | 169.9 |
| 0.241 | 58.9 | 826 | 3427 | 55.2 | 229 |
| AVERAGE | 53.72 | | | | 239.2 |

Figure 15:
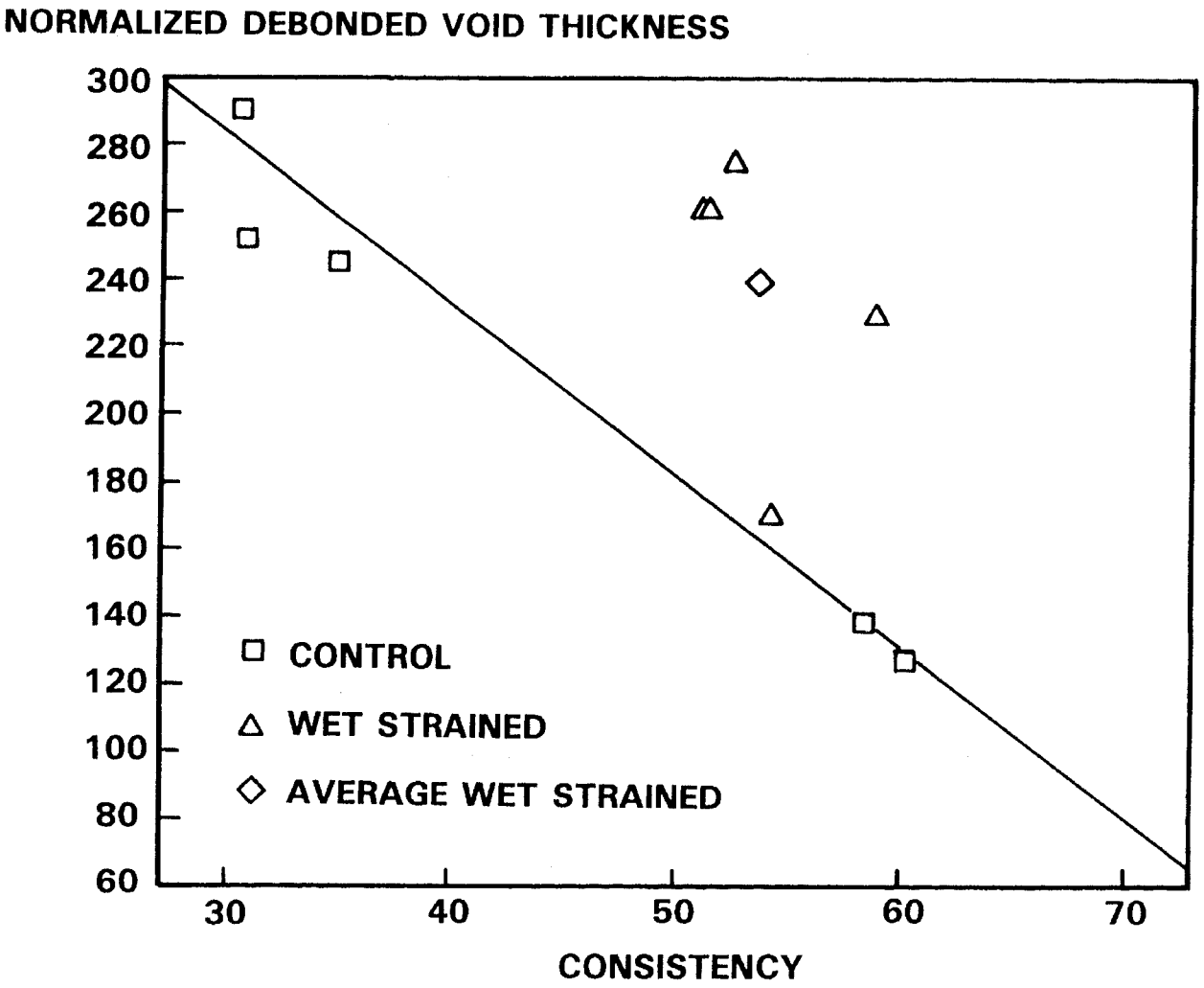
FIG. 15 is a plot of the Debonded Void Thickness as a function of consistency, illustrating the data as described in Example 2.

As shown in FIG. 15, the line in this figure is a regression line for the control data according to the equation: Normalized Debonded Void Thickness=444.5–(5.22×Consistency). As expected, the Normalized Debonded Void Thickness linearly decreased with pressing. While pressing is an effective means for removing water, it causes densification that reduces the Normalized Debonded Void Thickness and makes the resulting sheet less bulky and absorbent.

Also shown in FIG. 15 are the data points for the five wet straining samples and the arithmetic average for the five samples. The average Normalized Debonded Void Thickness of 239.2 at an average consistency of 53.7 percent was 46 percent higher than the predicted value of 163.8 at 53.7 percent consistency from the regression equation. This increase in Normalized Debonded Void Thickness is the desired result of the wet straining operation.

Hence it is clear that wet straining can be used to significantly increase the Debonded Void Thickness of paper. The benefits of this process can be manifested as higher Debonded Void Thickness at a given level of pressing or as the ability to press to a higher consistency while maintaining a given level of Debonded Void Thickness. Which approach is best depends on the amount of bulk and absorbency desired for a given product and the limitations of the particular papermaking process being utilized. In either case, an improved product can be produced via wet straining in accordance with this invention.

It will be appreciated that the foregoing examples, given for purposes of illustration, are not to be construed as limiting the scope of this invention, which is defined by the following claims and all equivalents thereto.

We claim:

1. A method for making a throughdried tissue product comprising:

(a) depositing an aqueous suspension of papermaking fibers onto an endless forming fabric to form a wet web;

(b) transferring the wet web to a throughdryer fabric and partially drying the web in a first throughdryer to a consistency of from about 28% to about 45%;

(c) sandwiching the partially-dried web between the throughdryer fabric and a coarse fabric;

(d) deflecting the web to substantially conform the web to the contour of the coarse fabric;

(e) carrying the web on the throughdryer fabric over a second throughdryer to dry the web to a consistency of about 85% or greater;

(f) transferring the throughdried web to a Yankee dryer; and (g) creping the web.

2. The method of claim 1 wherein the web is deflected by pneumatic means.

3. The method of claim 2 wherein the web is deflected with vacuum suction at a level of from about 10 to about 28 inches of mercury.

4. The method of claim 3 wherein the level of vacuum is from about 15 to about 25 inches of mercury.

5. The method of claim 1, wherein upon deflection of the web, the Normalized Debonded Void Thickness of the web is increased about 10 percent or greater.

* * * * *